US006186490B1

(12) United States Patent
Sugiura et al.

(10) Patent No.: US 6,186,490 B1
(45) Date of Patent: Feb. 13, 2001

(54) BILL DISPENSING DEVICE

(75) Inventors: Akihiro Sugiura, Seto; Shinji Shibata; Riichi Kato, both of Nagoya; Kunihiro Matsuura, Ama-gun, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/396,734

(22) Filed: Sep. 15, 1999

(30) Foreign Application Priority Data

Sep. 17, 1998 (JP) ..... 10-263421

(51) Int. Cl.[7] ..... B65H 5/00

(52) U.S. Cl. ..... 271/10.09; 271/10.11; 271/120; 271/121

(58) Field of Search ..... 271/10.09, 10.11, 271/119, 120, 121

(56) References Cited

U.S. PATENT DOCUMENTS 4,779,861 10/1988 Ozawa et al. .
5,098,078 * 3/1992 Nakanishi ..... 271/10.11
5,687,963 11/1997 Mennie .

FOREIGN PATENT DOCUMENTS 60-202024 10/1985 (JP) .
63-167416 7/1988 (JP) .
6-312845 11/1994 (JP) .

* cited by examiner

*Primary Examiner*—David H. Bollinger
(74) *Attorney, Agent, or Firm*—Mattingly, Stanger & Malur, P.C.

(57) ABSTRACT

To provide a bill dispensing device capable of handling bills widely differing from each other in paper quality and creases with high reliability and of handling all the bills of widely different lengths with respect to a delivery direction. A bill dispensing device comprises a bill container for containing sheets, rotating feed rollers for feeding bills to the next device, respectively having highly frictional parts (rubber members) in their circumferences, and nonrotatable gate rollers disposed opposite to the feed rollers and respectively having highly frictional parts in their circumferences. Pickup rollers respectively having highly frictional parts in their circumferences are disposed coaxially with the feed rollers and not opposite to the gate rollers so as to rotate together with the feed rollers.

24 Claims, 8 Drawing Sheets

BILL DISPENSING DEVICE

BACKGROUND OF THE INVENTION

The present invention relates to a sheet dispensing device, particularly to be incorporated into, for example, a bill handling and dispensing unit of an automatic transaction system, cash dispenser.

A device of this construction is proposed in, for example, Japanese Utility Model Laid-open No. 63-167416 for "Sheet Delivery Controller". This publication describes about feeding of the bill by the feed roller that corresponds to the friction roller for the bills repeatedly stored. The separation promotion component of high friction and high modules member is placed in front of both rollers. The separation promotion component comes in between both rollers, when it separates a bill by both rollers rotating. By this, it has been explained that the bill is separated.

SUMMARY OF THE INVENTION

FIGS. 11 and 12 show proposed sheet dispensing devices useful in setting forth the inventors analysis of problems and their causes in sheet feeding, as a part of the invention.

The sheet dispensing device shown in FIG. 11 is incorporated into a system principally for handling bills at a high rate. The sheet dispensing device shown in FIG. 11 comprises a rotating feed roller 102 having a highly frictional part 101, a nonrotatable gate roller 103 having a highly frictional part in its circumference and disposed opposite to the feed roller 102, a pickup roller 104 for delivering bills, having a highly frictional part 107 in its circumference, and a pressure plate 110 urged by a spring 109 so as to press a stack of bills contained in a bill storage space having wall 131 against the pickup roller 104 by a fixed pressure.

The sheet dispensing device shown in FIG. 12 does not have any member corresponding to the pickup roller 104 shown in FIG. 11. As shown in FIG. 12, the sheet dispensing device has a feed roller 102 having a highly frictional part 101 in its circumference and disposed with a part thereof included in a bill storage space. A stack of bills is pressed by a fixed pressure against the feed roller 102, and the highly frictional part 101 of the feed roller 102 delivers bills stored in the bill storage space one at a time.

The sheet dispensing device shown in FIG. 11 is designed to handle Japanese Yen bills and places the following restrictions on the size of bills to be handled by the sheet dispensing device. The feed roller 102 and the pickup roller 104 rotate continuously to deliver bills at a high rate one at a time at equal intervals by exerting frictional force to the bills by the highly frictional parts 101 and 107 formed in parts of the circumferences thereof, respectively, and the bills are separated one by one by the cooperative action of the feed roller 102 and the gate roller 103 disposed opposite to the feed roller 102. Therefore, the length of the bills with respect to the delivery direction may sufficiently be shorter than the circumferences of the feed roller 102 and the pickup roller 104, i.e., $\pi \times D$ (D is the diameter of the pickup roller 104), and may be greater than a length of L+R (L is the distance between a point where the feed roller 102 and the gate roller 103 overlap each other and the pickup roller 104, and R is the length of the highly frictional part of the pickup roller 104.) Therefore, the diameters D of the feed roller 102 and the pickup roller 104 may be increased to handle bills greater in size, which entails increase in the size of the device.

On the other hand, when sending out creased bills or infirm bills, longer bills are more liable to be buckled and to cause faulty delivery. Accordingly, different sheet dispensing devices differing in the dimensions D, L and R is to be used to handle foreign bills of sizes varying in a wide range, other than that of Japanese Yen bills. Furthermore, it is difficult to determined appropriate dimensions in designing a sheet dispensing device capable of handling bills including different kinds of bills of greatly different sizes, and hence the sheet dispensing device imposes restrictions on the size of bills.

The sheet dispensing device shown in FIG. 12 does not have any member corresponding to the pickup roller 104 of the sheet dispensing device shown in FIG. 11. This sheet dispensing device is unable to send out satisfactorily bills having folds and different paper qualities depending on the period of circulation if only the feed roller 102 is used, and the device is liable to fail in sending out the bills or to dispense the bills in skew positions due to the application of unbalanced forces to the bills.

It is an object of the present invention to solve the foregoing problems and to provide a compact sheet dispensing device capable of handling sheets of various paper qualities and various creased conditions with high reliability and of dealing with operations for sending out sheets of different sizes and different lengths.

Broadly, the solution involve reducing L by reconstructing the pickup and feed elements while keeping their functions. The best mode is to reduce L to zero.

With the foregoing objects in view, according to a first aspect of the present invention, a sheet dispensing device comprises a sheet container for containing sheets; rotating feed rollers 2 for feeding sheets to the next device, having highly frictional parts (rubber parts 22) in its circumference, and nonrotatable gate rollers 3 disposed opposite to the feed rollers 2 and respectively having highly frictional parts in their circumference; wherein pickup rollers 4 respectively having highly frictional parts in their circumferences are disposed coaxially with the feed rollers 2 and not opposite to the gate rollers 3 so as to rotate together with the feed rollers (FIGS. 1 and 3). According to a second aspect of the present invention, a sheet dispensing device comprises feed rollers 2, and guide rollers 13 disposed coaxially with the feed rollers 2 so as to rotate together with the feed rollers 2, having a diameter slightly greater than that of the feed rollers, and each having a part of a phase corresponding to a phase in which the highly frictional parts (rubber parts 22) of the feed rollers start delivering a sheet, having a diameter sufficiently smaller than that of the feed rollers 2 (FIGS. 7 and 8).

DESCRIPTION OF THE PREFERRED EMBODIMENT

The present invention relates to a sheet dispensing device to be incorporated into, for example, a bill dispensing unit of an automatic transaction system. This sheet dispensing device is capable of identifying bills with high reliability regardless of the paper quality of bills variable with the period of circulation and folds formed in bills.

A bill dispensing device in a first embodiment according to the present invention will be described with reference to FIGS. 1 to 6.

Figure 6:
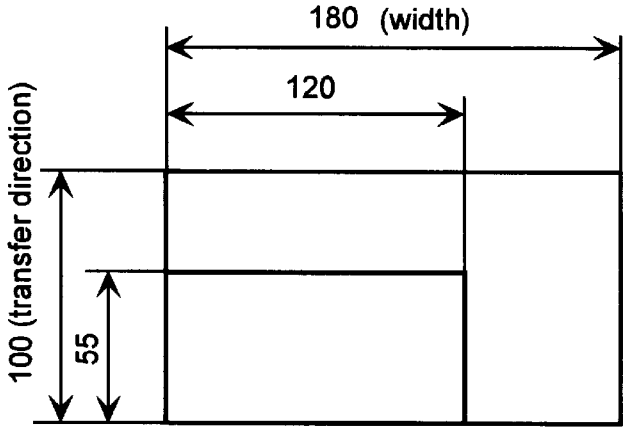
FIG. 6 is a diagram of assistance in explaining the sizes of bills to be handle by the bill dispensing device in the first embodiment.

The bill dispensing device is capable of handling bills of sizes in the range of 180 mm×100 mm (maximum size of the bill) to 120 mm×55 mm (minimum size of the bill) as shown in FIG. 6 which shows the size of not only the bills of Japan but also the bills used in foreign countries. Still, 55~100 mm shows the transfer direction (short direction of the bill) which carries the bill, and 120~180 shows width orientation (long direction of the bill) which stores the bill. This invention is the sheet (bill) dispensing device handling various size bills shown in FIG. 6.

Figure 1:
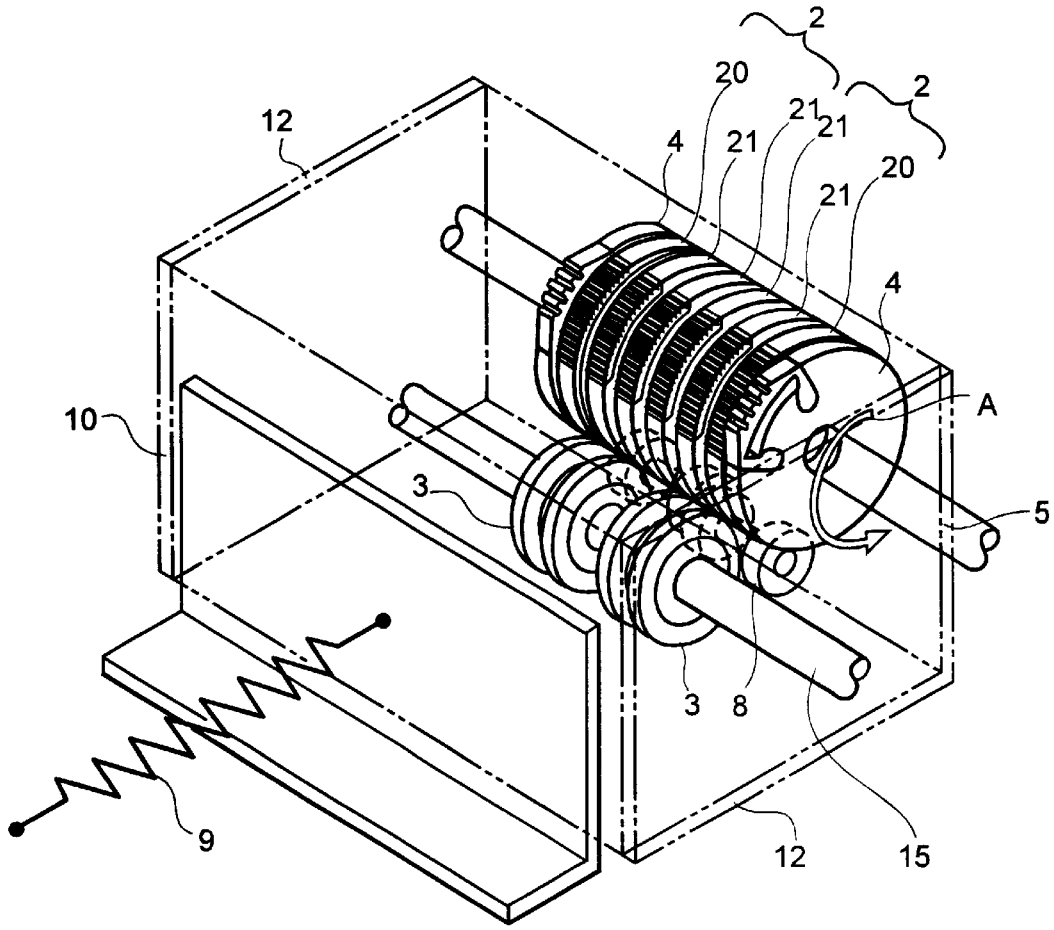
FIG. 1 is a perspective view of a bill dispensing device in a first embodiment according to the present invention.
Figure 3:
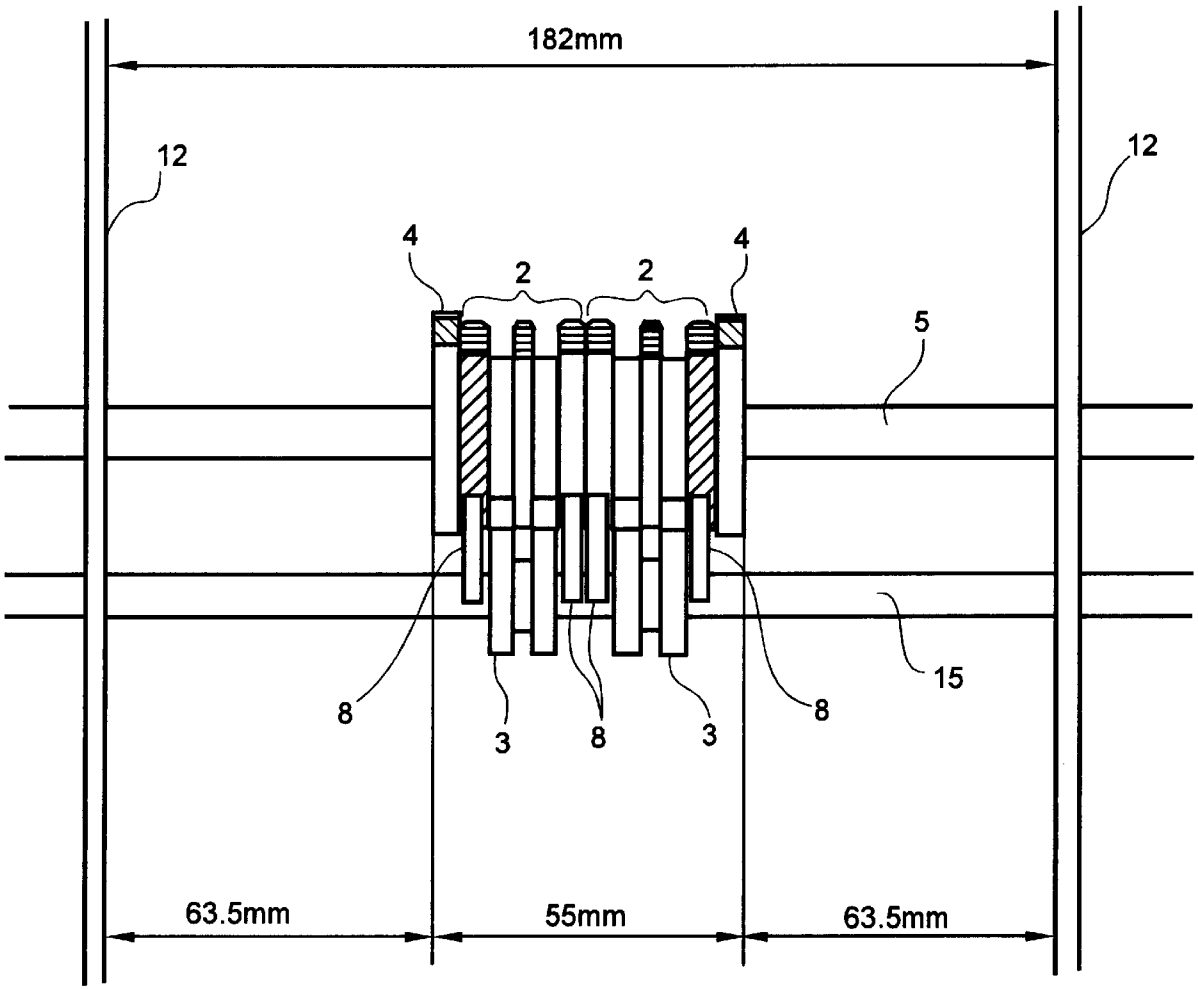
FIG. 3 is a view taken in the direction of the arrow in FIG. 2, showing the positioned relation between rollers.

In FIG. 1, the bill dispensing device has two feed members 2 mounted on a feed roller shaft 5, and each comprising three rollers, each having a highly frictional part of rubber in their circumferences. Fundamentally, there is a small force which sends the bill on the feed roller downstream. The feed roller has the function to prevent feeding of two bills between past the gate roller and a function to send the bill to the pinch roller. Two pickup rollers 4 are mounted on the feed roller shaft 5 near the opposite ends of the arrangement of the feed rollers 2, respectively. The pickup roller sends the bill out by pressing the bill. One of the features of the sheet (bill) dispensing device has pickup roller and feed roller in one shaft. Two gate rollers 3 are mounted on a gate roller shaft 15. The feed rollers 2 and the gate rollers 3 are axially staggered so as to overlap each other. The gate roller shaft 15 is adapted not to rotate in a feed direction through a one-way clutch, not shown. The gate roller has an abrasion surface of rubber on the circumference. The gate roller can be reversed by the one way clutch in the carrier direction of the paper money. Therefore, the abrasion of the rubber has been reduced by using the whole circumference of the gate roller. Four pinch rollers 8 are disposed opposite to the feed rollers 2 and are pressed against the feed rollers 2 as shown in FIG. 3 by springs. The bill dispensing device is provided with two side plates 12 for defining the width of a bill storage space, a pressure plate 10 movable toward and away from the pickup rollers 4 and the feed rollers 2, the front plate and the back plate, and thereby the bills are surrounded by the plates and stored.

The bill dispensing operation of the bill dispensing device will be described with reference to FIG. 2.

Figure 2:
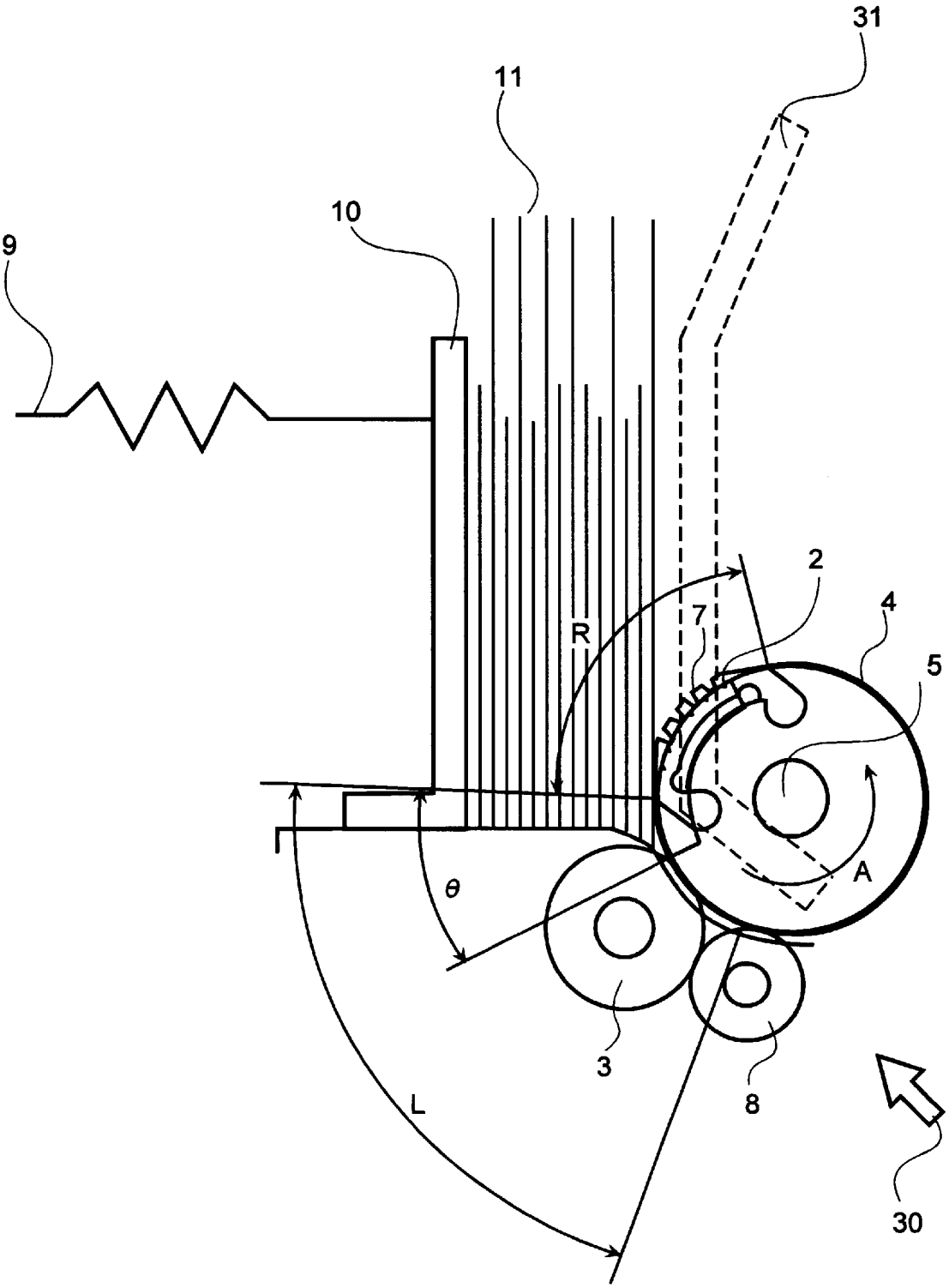
FIG. 2 is a side elevation of the bill dispensing device in the first embodiment.

Referring to FIG. 2, bills 11 are urged by the pressure plate 10 connected to a spring 9, so that the front bill 11 is pressed against the feed rollers 2 and the pickup rollers 4. The feed roller shaft 5 is driven for rotation in the direction of the arrow A by a motor. The bills are sent out by the pickup rollers 4 (the feed rollers 2 having a small force which slightly sends the bill), the bills are separated into individual bills in a region where the feed rollers 2 and the gate rollers 3 overlap each other, and the separated bill is delivered by the cooperative action of the feed rollers 2 and the pinch rollers 8 to a downstream delivery passage. This downstream delivery passage has means (not shown) for transfer of the bill and to distinguish the bill etc.

Bills of different sizes can be handled in the following manner. The feed rollers 2 are formed in a diameter of about 40 mm, the diameter of the pickup rollers 4 is 41 mm, which is greater than the diameter of the feed rollers 2 to send out the bills of the largest size at sufficient intervals, for obtaining the strong force for pressing to the bill before the pickup roller sends the bill out. The pressing force of the bill by the pressure plate 10 is not possible to feed roller but that it receives it by the pickup roller. If, the diameter of the pickup roller is decreased from the diameter of the feed roller pickup roller feed roller. The pressing force for the bill (before dispensing) by the pickup roller weakens, and sufficient dispensing force has not been obtained.

The respective circumferences of the feed rollers 2 and the pickup rollers 4 are about 126 mm (=π× about 40 mm), which is sufficiently greater than the length of 100 mm of the bills of the largest size with respect to a direction in which the bills are delivered (FIG. 6). By this, the bill is already sent out in the carrier direction, when the pickup roller revolved one rotation from the dispensing beginning for the bill (the maximum bill size) of first sheet. If the circumference length of the pickup roller is decreased relative to the carrier direction length of the bill, or the circumference length of the pickup roller is almost equal to the carrier direction length of the bill, the bill remains for two rotations of the pickup roller, and it is not possible to send the bill. Then, when the pickup roller is rotated in this condition, it becomes jammed and the double feed (sending two sheets) of the bill happens.

The length of the rubber parts (R) of the feed rollers 2 and the pickup rollers 4 is about 30 mm to send out the bill of the smallest size without making the rubber parts 7 of the pickup rollers 4 project and to deliver the bill surely to nipping points between the feed rollers 2 and the pinch rollers 8. When the rubber part sticks out more the next bill (second bill) is also sent out and the two sheet feed has arisen. Therefore it is regulated to about 30 mm so that the rubber part may not stick out of the bill. The sum L+R~50 mm, where L~20 mm is the distance between nipping points between the feed rollers 2 and the pinch rollers 8 and the point of contact between the pickup rollers 4 and the bill and R~30 mm is the length of the rubber parts 7 of the pickup rollers 4, is sufficiently smaller than the length of 55 mm of the bill with respect to the direction in which the bill is delivered. Because the pickup rollers 4 do not send out the next bill, when the leading edge of the smallest bill is at the nipping points between the feed rollers 2 and the pinch rollers 8.

The container has a width of 182 mm corresponding to the width of the largest bills at 180 mm, the storing width orientation, as shown in FIG. 6. The feed rollers 2 and the pickup rollers 4 are arranged in a middle region of 55 mm in width in a symmetrical arrangement with respect to the center line of the container as shown in FIG. 3, so that the feed rollers 2 and the pickup rollers 4 may not come into contact with the next bill and the two superposed bills may not be sent out even if bills of different sizes are contained in the container.

The construction of the rollers for stabilizing a bill delivering operation, which is a feature of the present invention, will be described below.

Figure 4:
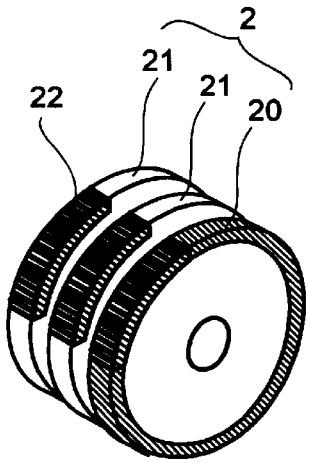
FIG. 4 is a perspective view of a feed roller.

As shown in FIG. 4, the feed roller 2 comprises two partly rubber-coated disks 21 each having a circumference having a section provided with a rubber member 22 and a low frictional section of aluminum or the like forming the rest of the circumference, and one fully rubber-coated disk 20 provided with a rubber member 22 covering the entire circumference thereof. The feed roller has whole circumference is rubber part and a part of the circumference is rubber part. And the feed roller of the part rubber mainly faces the gate roller, the feed roller of the whole circumference rubber mainly faces the pickup roller, as it is shown in FIG. 3. The reason for constituting the feed roller like this is explained. If the function is perfectly divided in order to the pickup roller have the dispensing function of the bill and in order to the feed roller have separation function of bill, it is theoretically possible that taking whole circumference of all feed rollers as a rubber. However the sheet dispensing device of this invention is also handled such as soft(medium) and break of the bill. Therefore, only by slightly increasing the diameter of the pickup rolle from the diameter of feed roller, rubber division of feed roller also receives the pressing force by the bill, and it will have some dispensing functions by the rotation of feed roller it. Like this, the part rubber of the feed roller is better like the pickup roller, because it has some dispensing functions. Because when all feed roller are composed of the whole circumference rubber, the next bill may be also sent out, and it becomes that the jam of the bill has been generated. In the other, the pinch roller is being pressed in the spring for feed roller. The pinch roller can not rotate in itself, it rotates by the following by the feed roller. Therefore, when all circumference of the feed roller are composed of the rubber in contact with pinch roller, carrier force of the bill can be strengthened. The feed roller contains the part rubber roller and the whole circumference rubber in order to solve the problem in which the above is contradictory. In addition, it is constituted in order to the feed roller of the part rubber face the gate roller, and in order to the feed roller of the whole circumference rubber face the pickup roller, (FIG. 3 ). The partly rubber-coated disks 21 and the fully rubber-coated disk 20 are finished in a diameter of about 40 mm in a high accuracy. The bills are sent out one (separated) at a time by the feed rollers 2 and the gate rollers 3 disposed between the adjacent disks of the feed rollers 2, and the bills are delivered by the feed rollers 2 and the pinch rollers 8 to the delivery passage one by one.

Figure 5:
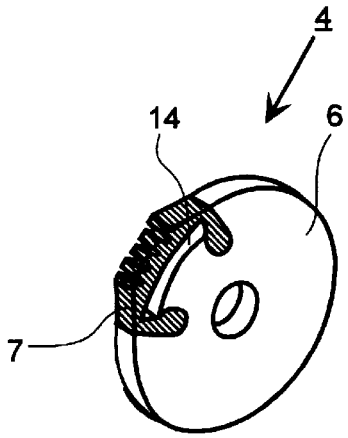
FIG. 5 is a perspective view of a pickup roller.

Referring to FIG. 5, the pickup roller 4 has a disk (boss part) 6 of a low frictional plastic material, and a rubber member 7 covering a section of the circumference of the disk 6. The rubber member 7 has a hardness lower than that of the rubber members 22 of the feed rollers 2. It is better that it is soft for rubber part of the pickup roller, since it wants to be made to generate the pressing force of the bill (dispensing force of the bill ). With the rubber division is soft, stabilized carrier force is obtained in the paper money with break and ruggedness of the printing. In the meantime, the gap (the slight clearance, and accuracy is good) between the feed roller and the gate roller is the clearance where one sheet per one sheet is carried by the bill separating. Therefore, when rubber part of the feed roller has been softened like the pickup roller, the gap between feed roller and gate roller gets the large clearance and the sure separation of the bill becomes difficult. The pickup rollers 4 are disposed near the opposite ends of the arrangement of the feed rollers 2, respectively. The outside diameter of the disk 6 is 41 mm, which is slightly greater than that of the feed rollers 2. A hollow 14 of a radial thickness of about 2 mm is formed between the disk 6 and the rubber part 7. The diameter of a circle having its center on the center of the disk 6 and including the outer surface of the rubber member 7 is 45 mm. Therefore, the radial difference between the circle including the outer surface of the rubber member 7 and the outer surface of the disk 6 is about 2 mm. During operation, the rubber member 7 is pressed by the bill, the hollow 14 is compressed completely, and the circle including the outer surface of the rubber member 7 coincides substantially with the circumference of the disk 6. Since the rubber member 7 is elastic, the hollow 14 is formed under the rubber member 7, and the outer surface of the rubber member 7 protrudes from the circumference of the disk 6, bills having different paper qualities variable with the period of circulation and folds formed therein can surely be drawn by the frictional action of the rubber members 7. Thus, the bills can be delivered stably without entailing skewing and jamming. Since the disks 6 of the pickup rollers 4 holds the bills pressed thereto by the pressure plate 10 and the rubber members 22 of the feed rollers 2 do not exert any frictional force on the bills in phases other than a bill delivery phase, the rubber members 7 of the pickup rollers 4 are able to exercise their periodic delivering action. The sheet dispensing device of this invention rotates pickup roller and feed roller continuously, and it sends out the first bill and the second bill as a predetermined distance. On the one revolution of each roller, the bill is sent out to one sheet. Then, the condition from contacting( it is pressed) to separating between the pickup roller and the bill is called a dispensing phase, because the condition of the angle of rotating roller is like a phase. In this invention, the dispensing phase for stored bills is almost same for both pickup rollers, feed rollers. The part which is not the rubber of both rollers are composed of plastic or metal, and the friction coefficient is low, and the carrier force is very small (it is almost nothing). If, in the condition except for the dispensing phase, it is heightened of the friction coefficient between the rollers and the bill, and the carrier force has arisen. When it is done, the initial state (it begins to turn out) of the bill has deviated (slipped), and the interval between the first bill and the second bill can not be set at the predetermined distance. And switching of the gate in the transfer, and discriminate of the bill are not possible occurs.

The rubber members 22 of the feed rollers 2 come into contact with the bills periodically at a pickup position and start exerting a drawing force on the bills to deliver the bills periodically at predetermined intervals. For such a purpose, the fully rubber-coated disks 20, 21 of each feed roller 2 may be substituted by a disk having a rubber member similar to the rubber member 22 of the partly rubber-coated disk 21 shown in FIG. 4. It is effective in exerting a sufficient frictional force on the bill to serrate the outer surfaces of the rubber members 22 as shown in FIGS. 1 and 4. The bills sent out one by one by between the feed rollers 2 and the gate rollers 3 are delivered periodically by the feed rollers 2 and the pinch rollers 8. Therefore, only each of the fully rubber-coated disks 20 employed in this embodiment is provided with the rubber member 22 covering the entire circumference thereof as shown in FIGS. 1 and 4. It is desirable that a section of the rubber member 22 other than a section of the same corresponding to the rubber members 22 of the partly rubber-coated disks 21 is capable of exerting only a low frictional force on the bill so that the bill may not be drawn out. Therefore, the section of the outer surface of the rubber member 22 other than the section of the same corresponding to the rubber members 22 of the partly rubber-coated disks 21 is not serrated. To further enhance this effect, the disks 6 of the pickup rollers 4 disposed on the outer sides of the second disks 20 of the feed rollers 2 are formed in a diameter of 41 mm, which is slightly greater than that of the feed rollers 2, to space the bill apart from the fully rubber-coated disks 20 so that the section of the outer surface of the rubber member 22 other than the section of the same corresponding to the rubber members 22 of the partly rubber-coated disks 21 may not start drawing out the bill.

Referring to FIG. 4, all the parts of the feed roller 2 excluding the rubber members 22 of the partly rubber-coated disks 21 and the fully rubber-coated disk 20 are formed of aluminum. This secures delivering force for the feed roller 2 and the pinch roller 8. Since the diameter of 41 mm of the pickup rollers 4 is greater by 1 mm than the diameter of the feed rollers 2, the bill will not be sent out in phases other than the bill delivery phase, and the rubber members 7 of the pickup rollers 4 exert frictional force on the bill in the bill delivery phase. It is highly effective to mount the feed rollers 2 and the pickup rollers 4 on the same shaft 5 and to form the pickup rollers 4 in the diameter greater than that of the feed rollers 2.

In the first embodiment shown in FIG. 1, the respective phases of the rubber members 7 of the pickup rollers 4 and the rubber members 22 of the feed rollers 2 are the same. The leading ends of the rubber members 22 of the feed rollers 2 may be advanced by an angle shown as θ relative to the leading ends of the rubber members 7 of the pickup rollers 4 as shown in FIG. 2. When the rubber members 7 and 22 are arranged in such positional relation, the delivering force of the rubber parts 7 of the pickup rollers 4, and the separating and delivering force of the rubber members 22 of the feed rollers 2 and the gate rollers 3 are simultaneously available when the leading edge of the bill is in an overlapping region in which the feed rollers 2 and the gate rollers 3 overlap each other, which is effective particularly in preventing the buckling of the infirm bills.

The bill dispensing device in this embodiment is capable of handling bills of greatly different sizes and of stably sending out bills having different paper qualities variable with the period of circulation and folds formed therein without entailing skewing and jamming.

Figure 7:
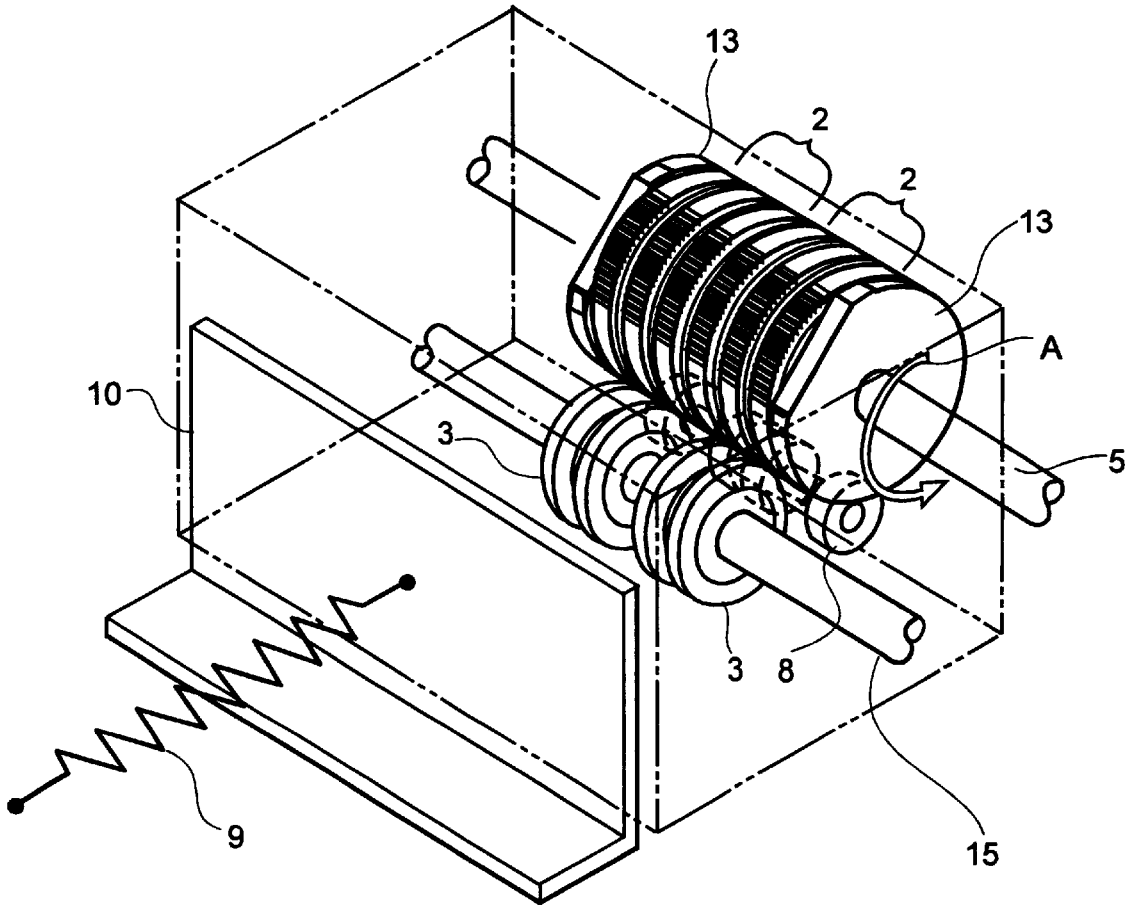
FIG. 7 is a perspective view of a bill dispensing device in a second embodiment according to the present invention.
Figure 8:
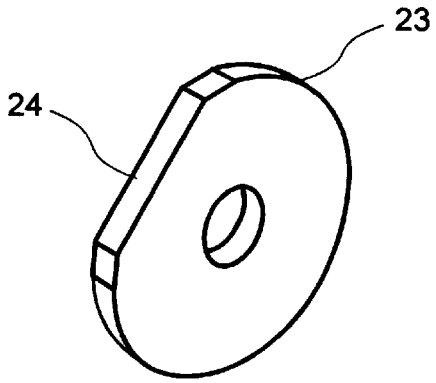
FIG. 8 is a perspective view of a guide roller.

A bill dispensing device in a second embodiment according to the present invention will be described with reference to FIGS. 7 and 8. FIG. 7 is a perspective view of the bill dispensing device in the second embodiment, and FIG. 8 is a perspective view of a guide roller.

The bill dispensing device in the second embodiment is substantially the same in construction as the bill dispensing device in the first embodiment shown in FIG. 1, except that the former employs guide rollers 13 instead of the pickup rollers 4. The guide rollers 13 and feed rollers 2 are mounted on the same shaft 5. Each guide roller 13 has a circumference having a circular section 23 of a diameter slightly greater than that of the feed rollers 2, and a flat section 24 corresponding to sections of the feed rollers 2 provided with rubber members, the flat section 24 having a diameter sufficiently smaller than that of the feed roller 2. The guide roller 13 is formed of, for example, a low frictional plastic material.

The circular section 23 and the flat section 24 of the guide rollers 13 modulate the drawing force of the rubber members of the feed rollers 2. The circular sections 23 hold bills pressed thereto by a pressure plate so as to separate the bills from the feed rollers 2 of the diameter smaller than that of the circular sections 23 of the guide rollers 13 in a phase in which the low frictional parts of the feed rollers are in contact with the bill other than a bill delivery phase. Since the bills are not pressed against the feed rollers 2 of the diameter smaller than that of the circular sections 23 of the guide rollers 13, the bills are not sent out. In the bill delivery phase, the highly frictional sections of the feed rollers 2, i.e., the rubber members 22, corresponding to the flat sections 24 of the guide rollers 13 come into contact with the bills and the bills are firmly pressed against the feed rollers 2, so that the bills are sent out by the feed rollers 2. The parts of the guide rollers 13 in contact with the bill changes suddenly from the circular section 23 to the flat section 24 at the start of the bill delivery phase, the bills are moved suddenly toward the feed rollers 2 by the pressure plate, so that the bills are pressed against the feed rollers 2 by an impact force, so that the bill drawing force can well be modulated and the bills can stably drawn out.

The pickup rollers (first embodiment) or the guide rollers (second embodiment), and the feed rollers are mounted on the same shaft, and the pickup rollers or the guide rollers are disposed near the opposite ends of the arrangement of the feed rollers, respectively. Therefore, the bills are rarely skewed and jammed. However, the pickup rollers or the guide rollers need not necessarily be disposed only near the opposite ends of the arrangement of the feed rollers. An additional pickup roller or an additional guide roller may be disposed, for example, at the middle of the arrangement of the feed rollers. In an arrangement shown in FIG. 9, pickup rollers 4 and feed rollers 2 are mounted on the same shaft 5, and the pickup rollers 4 are disposed at positions near the opposite ends and at the middle of the arrangement of feed rollers 2, respectively. The pickup roller disposed at the middle of the arrangement of the feed rollers 2 is effective in stably delivering bills having folds therein.

Figure 10:
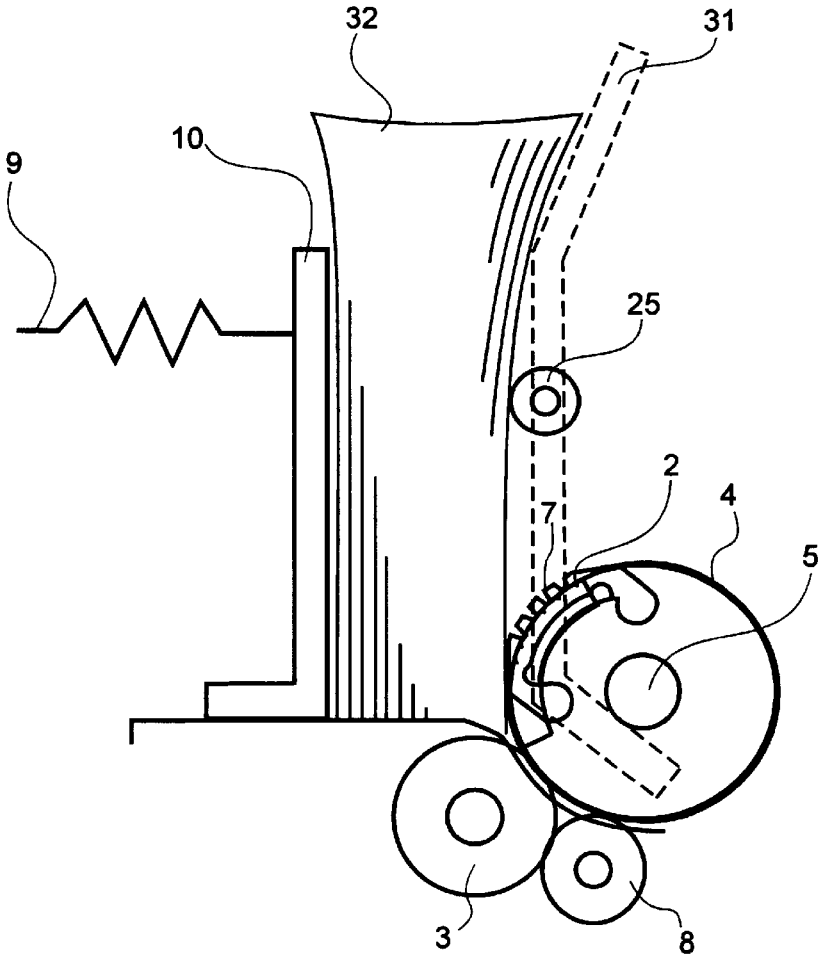
FIG. 10 is a side view, similar to FIG. 2, showing a free, rotating roller 25 supported on a front plate 31 shown in FIG. 2.
Figure 11:
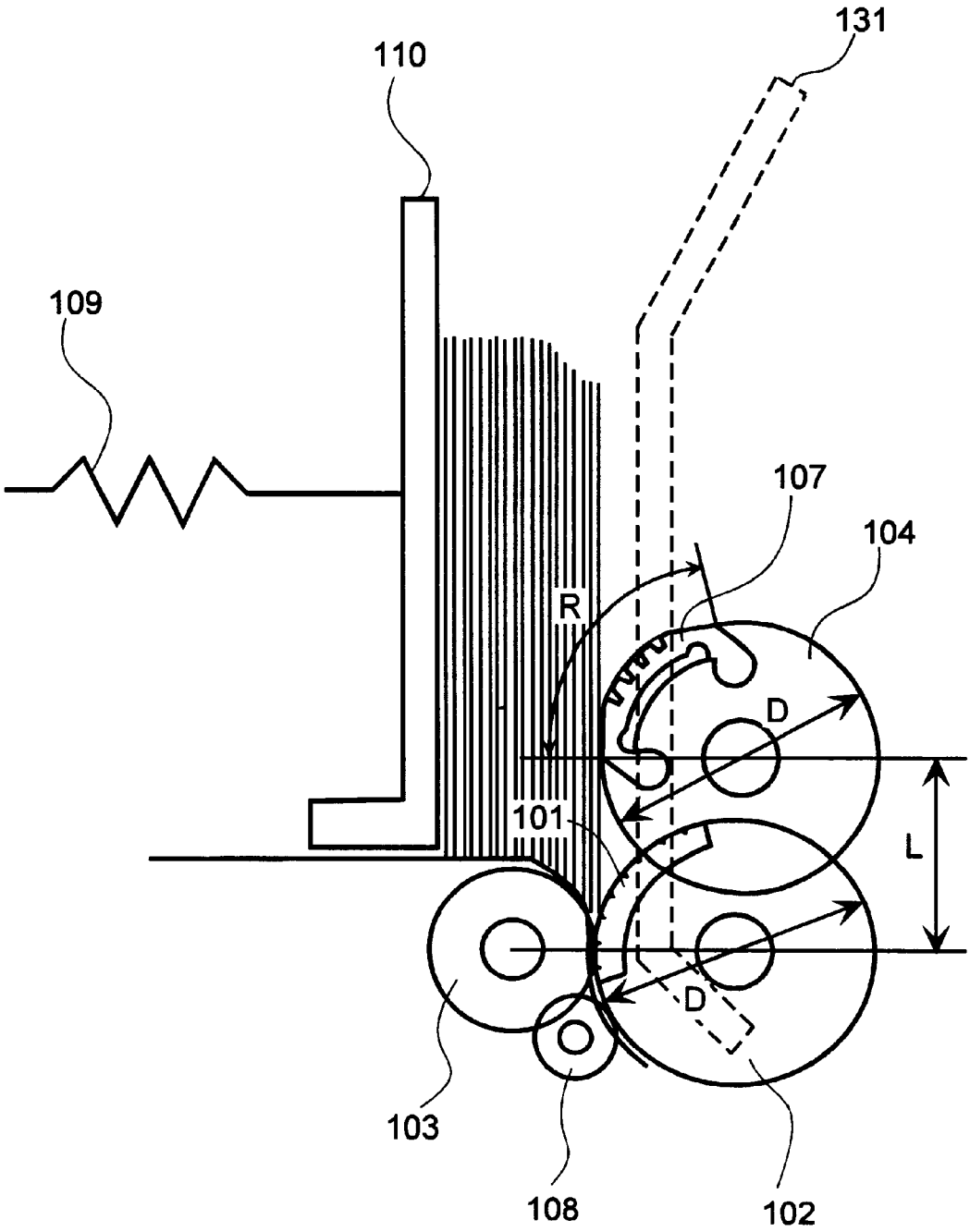
FIG. 11 is a side elevation of a sheet dispensing device.
Figure 12:
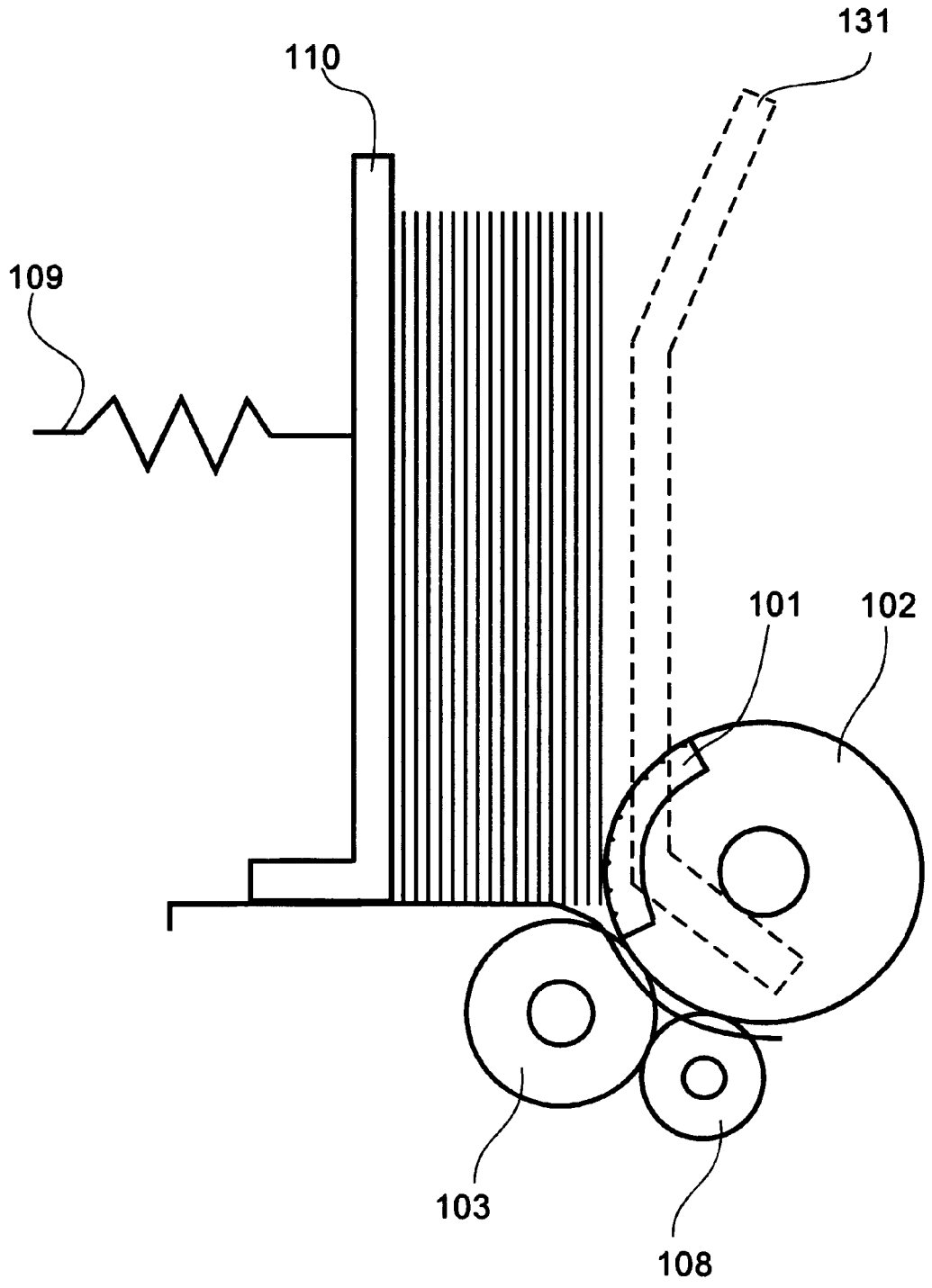
FIG. 12 is a side elevation of another sheet dispensing device.

In a modification, a front plate is employed in supporting the bills pressed by the pressure plate, a free, rotating auxiliary roller is supported on the front plate to enable the bills to be sent out more smoothly. FIG. 10 shows the bill dispensing device shown in FIG. 2 additionally provided with a front plate 31 for holding sheets 32 pressed thereon by the pressure plate 10, and a free, rotating roller 25 supported on the front plate 31. The free, rotating roller 25 reduces resistance exerted by the front plate 10 on sheets, such as tickets or bills having folds, when sending out the sheets. The free rotating roller 25 is effective when the same is supported on the front plate 10 so that the sheets convexly curving toward the front plate 10 above the feed roller 2 come into contact with the free rotating roller 25.

Figure 9:
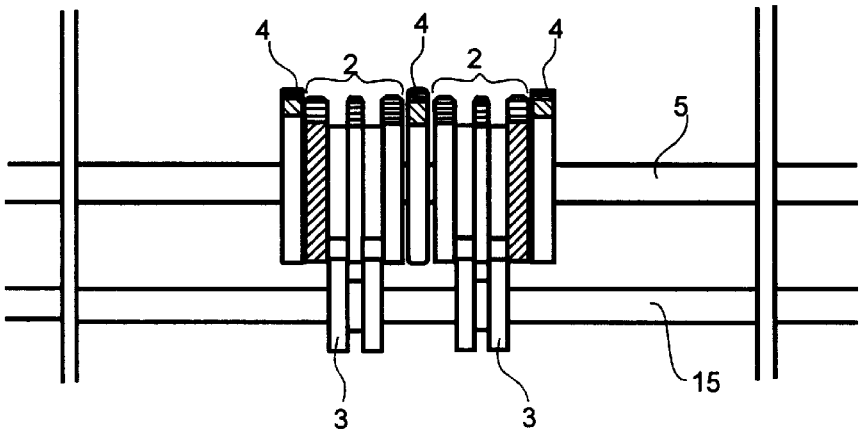
FIG. 9 is a front elevation of a roller arrangement including feed rollers and pickup rollers 4 mounted on the same shaft with the pickup rollers 4 disposed at positions near the opposite ends and at the middle of the arrangement of the feed rollers, respectively.

As shown in FIGS. 3 and 9, the disks of the feed rollers 2 and the gate rollers 3 are arranged axially alternately so as to overlap slightly each other. In a modification, the gate rollers may be disposed so as to correspond to the disks of feed rollers, respectively, and a shaft supporting the gate rollers may be urged by springs so as to pressed gate rollers against the corresponding disks of the feed rollers. In this modification the pickup rollers 4 or the guide rollers 13 exercises the same effect.

As is apparent from the foregoing description, the present invention provides a compact sheet dispensing device capable of handling sheets of various paper qualities, such as bills, with high reliability and of handling all the sheets of widely different lengths with respect to a delivery direction.

What is claimed:

1. A bill dispensing device for dispensing currency bills, comprising:

a bill container for containing the bills;

a rotating feed roller for feeding bills to the next device, having a highly friction part in its circumference;

a nonrotating gate roller disposed opposite to said rotating feed roller and having a highly friction part in its circumference;

a pickup roller having a highly friction part in its circumference that is disposed coaxially with said feed roller; and said feed roller is disposed opposite to said gate roller so as said pickup roller rotates together with said feed roller.

2. The bill dispensing device according to claim 1, wherein said pickup roller has a diameter greater than that said feed roller.

3. The bill dispensing device according to claim 1, wherein the highly frictional part of the circumference of said pickup roller has an elasticity lower than that of the highly frictional part of the circumference of said feed roller.

4. The bill dispensing device according to claim 1, wherein the highly frictional part of the circumference of said pickup roller have a diameter greater than that of other parts of the circumference of the same, and hollow is formed radially inside the highly frictional part of the circumference of said pickup roller in order that the outside diameter of the highly frictional part of the circumference of the pickup roller is reduced to the diameter of the parts of the circumference of said pickup roller other than the highly frictional part of the same when the highly frictional part is pressed and deformed by a bill to be delivered so as to compress the hollow.

5. A bill dispensing device comprising:

a bill container for containing bills;

a feed roller for conveying bills to the next device, having a highly frictional part in its circumference;

a gate roller disposed opposite to said feed roller and having a highly frictional part in its circumference; and a guide roller disposed co-axially with said feed roller so as to rotate together with said feed roller, having a diameter slightly greater than that of said feed roller, and each has a part of a phase corresponding to a phase in which the highly frictional part of said feed roller start delivering a bill, having a diameter smaller than that of said feed roller.

6. The bill dispensing device according to claim 5, wherein said guide roller is disposed coaxially with at least said feed roller near the opposite end of the arrangement of said feed roller.

7. The bill dispensing device be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said first rotating element includes a pickup roller, said pickup roller including a part of rubber of high friction and another part of hardness lower than said rubber in a circumference.

8. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said second rotating element includes plural feed rollers, and said plural feed rollers including a fully rubber-coated roller and a partly rubber-coated roller.

9. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said first rotating element includes a pickup roller having a rubber part, said second rotating element having a feed roller having a rubber part, and said rubber of said pickup roller has an elasticity lower than said rubber part of said feed roller.

10. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said second rotating element has plural feed rollers, said feed rollers including a fully rubber-coated roller and a partly rubber-coated roller, and said partly rubber-coated roller arranged opposite and closely adjacent said friction element.

11. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

further comprising a pinch roller for sending the bill, wherein said pinch roller is arranged opposite said second rotating element.

12. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein the diameter of said first rotating element is greater than the diameter of said second rotating element.

13. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said first rotating element has a rubber part of the high friction, said rubber part is formed outward of a hollow.

14. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said first rotating element has a rubber part covering the circumference, said second rotating element has a rubber part covering the circumference, a leading end of said rubber part of said second rotating element is advanced relative to a leading end of said. rubber part of said first rotating element in a dispensing phase.

15. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

further comprising a pinch roller sending out the bill to a downstream delivery passage, wherein said second rotating element has a fully rubber-coated roller and a partly rubber-coated roller, said fully rubber-coated roller arranged opposite said pinch roller, and said partly rubber-coated roller arranged opposite said friction element.

16. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said friction element includes a gate roller, said gate roller is not rotatable in a feed direction of the bills, and is rotated in a direction opposite the feed direction.

17. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

wherein said first rotating element has a part of a diameter greater than that of said second rotating element and a part of a diameter smaller than that of said second rotating element.

18. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

further comprising a free roller, wherein said bill container includes a front plate, and said free roller is supported on said front plate.

19. The bill dispensing device to be used to dispense bills of various size, comprising:

a bill container for containing the bills;

a first rotating element arranged for rotating about an axis, and having a contact point of the part of the bills stored in said bill container;

a second rotating element arranged for rotating on said axis;

a friction element arranged closely adjacent and opposite to said second rotating element;

said first rotating element and said second rotating element rotating in phase on said axis to send out the bills stored in said bill container; and said second rotating element and said friction element separating the bills one at a time;

said bill container is sized to contain bills of sizes of 55–100 mm in the feed direction.

20. A bill dispensing device for dispensing currency bills along in a dispensing direction, comprising:

a bill container for containing the bills;

a rotating element having a highly frictional circumference feed part, for feeding the bills in the direction from said container;

a nonrotating, with respected to the direction, gate element disposed opposite to said rotating element feed part and said gate element having a highly frictional part opposed to said circumference part to prevent the feeding of two of the bills simultaneously;

said rotating element having a highly frictional circumference pickup part disposed coaxially with axially spaced from said feed part; and said pickup part rotates together with said feed part.

21. The bill dispensing device according to claim 20, wherein said roating elemement includes a pickup roller and a feed roller.

22. A currency bill dispensing device for handling different size bills and moving them along a feed path in a feed direction, comprising:

a bill container for containing, the bills prior to dispensing;

a unitary feed member movable in a feed direction and for feeding bills and having highly friction part engaging a lead bill in said container;

a gate member immovable in the feed direction and disposed opposite to said feed member and having a frictional part to engage one or more bills being fed by said feed member;

a pickup member having highly frictional part disposed unitarily with said feed member and not opposite to said gate member so as to move together with said feed member in the feed direction.

23. The bill dispensing device according to claim 22, wherein said feed member includes a feed roller and said pickup member includes a pickup roller.

24. The bill dispensing device according to claim 22, wherein the pickup member is closer to the feed path than said feed member.

* * * * *